US009044094B2

(12) United States Patent
Chen

(10) Patent No.: US 9,044,094 B2
(45) Date of Patent: Jun. 2, 2015

(54) CHAIR CHASSIS

(76) Inventor: Yucheng Chen, Guangzhou (CN)

( * ) Notice: Subject to any disclaimer, the term of this patent is extended or adjusted under 35 U.S.C. 154(b) by 274 days.

(21) Appl. No.: 13/525,352

(22) Filed: Jun. 17, 2012

(65) Prior Publication Data

US 2013/0069408 A1 Mar. 21, 2013

(30) Foreign Application Priority Data

Sep. 15, 2011 (CN) ..... 201120349329

(51) Int. Cl.

| | |
|---|---|
| ***A47C 7/00*** | (2006.01) |
| ***A47C 1/032*** | (2006.01) |
| ***A47C 3/30*** | (2006.01) |

(52) U.S. Cl.

CPC ..... *A47C 1/03238* (2013.01); *A47C 1/03205* (2013.01); *A47C 1/03266* (2013.01); *A47C 1/03272* (2013.01); *A47C 3/30* (2013.01)

(58) Field of Classification Search

CPC ..... A47C 1/03238; A47C 1/30205; A47C 1/30266; A47C 1/30272; A47C 3/30; A47C 7/00

USPC ..... 297/362.14, 300.1, 463.1, 311, 337, 297/301.1, 301.4, 300.2, 300.5

See application file for complete search history.

(56) References Cited

U.S. PATENT DOCUMENTS 7,147,285 B2 * 12/2006 Lin ..... 297/301.1

* cited by examiner

*Primary Examiner* — Milton Nelson, Jr.

(57) ABSTRACT

A chair chassis, comprising a chassis pedestal, a left and a right connecting rod for back, a seat supporting frame, an adjusting handle, the adjusting handle comprises an adjusting screw rod. On the adjusting screw rod exists a locating block for mounting handle and, the first pulling line and the second pulling line are wrapped around it, the two pulling lines are respectively used to lock or unlock the tilting angle of the back and to lock or unlock the position of the supporting frame; the adjusting handle also comprises a block for the pulling line, which is connected with the third pulling line, and the block for the pulling line is connected with the adjusting screw rod and can relatively slide on it. The invention is multi-functioned with the action of only one adjusting handle, and the structure of the invention is compact, and it is convenient to operate.

8 Claims, 6 Drawing Sheets

CHAIR CHASSIS

FIELD OF THE INVENTION

Embodiments of the present invention relate to chair accessories, and more specifically to a simple-structured, easy-operated and ergonomic chair chassis.

BACKGROUND OF THE INVENTION

The current chair chassis only can achieve the basic function of adjusting the height of chair to be adapted to the users. When it is related to the condition that the back needs to be tilted or the seat needs to be moved forward and backward, the controlling handle needs to be applied. For instance, when a handle is used to adjust the tilting angle of the seat, another handle is also needed to lock or unlock the tilting angle of the back. When we need to adjust the position of the seat, a handle will be needed. There is also another handle for the lifting of the seat. The number of the handles is quite a few, and this will have art influence on the aesthetic of the whole chair.

Height of the current chair can only be adjusted by pulling up the handle, but it can't be adjusted by rotating the handle in a full range.

SUMMARY OF THE INVENTION

In order to overcome the disadvantages of the prior art, the present invention provides a multi-function chair chassis, which is mounted by an adjusting handle. It can provide users with comfort.

A chair chassis includes a chassis pedestal, on which exist a left and right connecting rod that is tiltable and connected with a back of the chair; a supporting frame that can move forward and backward, used to support a seat of the chair; and an adjusting handle, which is fixed axially on the chassis pedestal. The adjusting handle comprises an adjusting screw rod. On one end of the adjusting screw rod exists spiral teeth, which can adjust the angle of the back by rotating.

A locating block of the mounting handle is set on the adjusting screw rod. A first pulling line is wrapped around the locating block, and it can lock or unlock the right or left tilting angle of the connecting rods.

A chair chassis according to embodiments of the present invention includes a second pulling line, which can lock and unlock tilting angle of the left and right connecting rod of the back. The second pulling line is wrapped around the block of the mounting handle. The wrapping direction of the second pulling line is opposite to the wrapping direction of the first pulling line.

The adjusting handle comprises a block. The block is fixed with the third pulling line, and the block can relative slide along the adjusting screw rod.

When the adjusting screw rod of the adjusting handle is turned around, the spiral teeth of the adjusting screw rod will adjust the tilting elasticity of the left and right connecting rod on the chassis. This adjusts the back's elasticity. The tilting of the back will be further adjusted by the force of the users or other force. The locating block of the adjusting handle can be adjusted in different directions. The first pulling line can be pulled to lock or unlock the tilting angle of the connecting rods of the back. The second pulling line also can be pulled to lock or unlock the location of the supporting frame of the seat. When the block of the pulling line is pulled along the direction of the adjusting handle, the third pulling line will be pulled to adjust the seat height of chair.

The invention have several advantages. The user can separately control the different parts of the adjusting handle, in order to control the tilting and the locking of the back, the locking of the seat and the lifting of the chair, thereby providing a compact and easy-operated structure.

DETAILED DESCRIPTION OF THE PREFERRED EMBODIMENT

Figure 1:
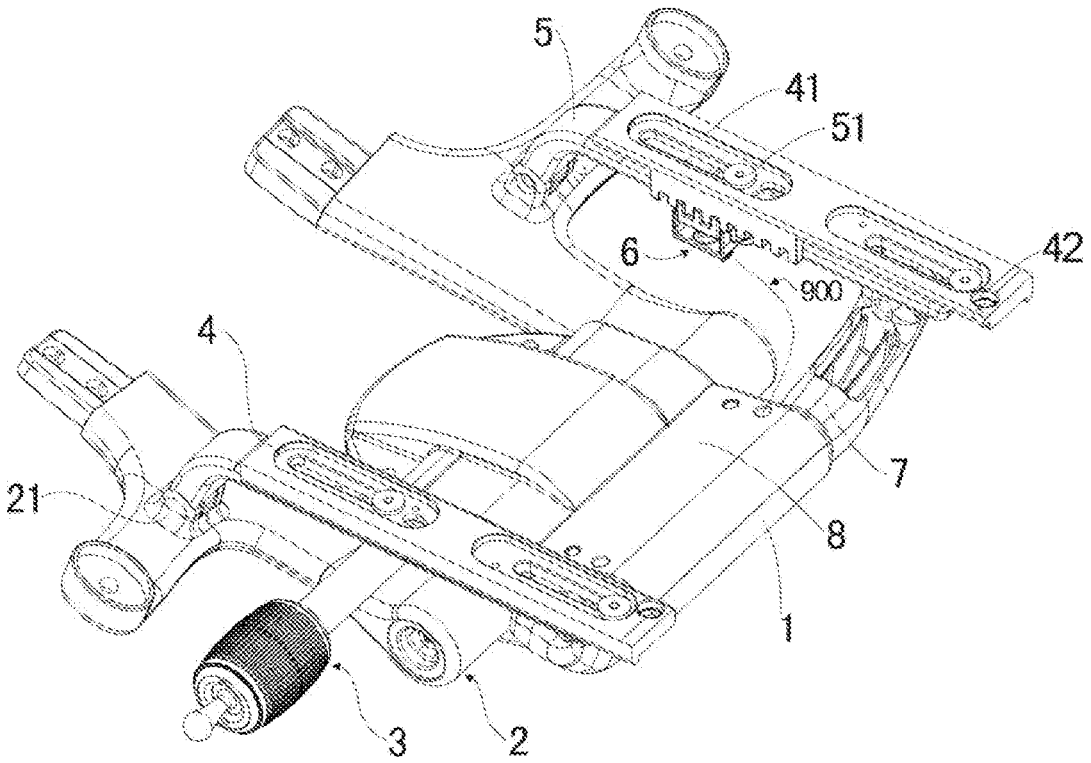
FIG. 1 is a schematic diagram of the whole structure in accordance with the present invention.

The following illustrations are further explanations of the invention, with the instructions of the concrete embodiment and figures.

Referring to FIGS. 1-9, the chair chassis comprises a chassis pedestal 1; a left and right connecting rod 2, connected with the back, which is tiltable and set on the chassis pedestal 1; a seat supporting frame 4 used to support the forward and backward moving of the seat, and an adjusting handle 3, set on the chassis pedestal 1. The adjusting handle 3 comprises an adjusting screw 374. One end of the adjusting screw 374 exist the spiral teeth 373, which can be turned around to adjust elasticity of the back.

The locating block 38 of the mounting handle is set on the adjusting screw rod 374, and a first pulling line 902 is wrapped around the locating block 38 of the mounting handle. The first pulling line can lock or unlock the tilting angle of the back.

A second pulling line 900 is also wrapped around the locating block 38 of the mounting handle, which can lock or unlock the position of the seat supporting frame 4. The wrapping direction of the second pulling line 900 is opposite to the wrapping direction of the first pulling line 902.

The adjusting handle 3 comprises a block 36 for the pulling line, which is connected with a third pulling line 901. The block 36 of the pulling line is connected with the adjusting screw rod 374.

The adjusting handle 3 of the chassis pedestal 1 can achieve tilting and locking of the back, or/and locking of the back's forward and backward moving, or/and the lifting control of the seat. The spiral teeth 373 of the adjusting handle 3, the first pulling line 902, the second pulling line 900 and the third pulling line 901 can be controlled respectively to achieve the various control of the chassis.

Specifically, referring to FIG. 1, the chair chassis comprises the chassis pedestal 1, a rubberizing shell 8, the left and right connecting rod 2 of the back, the supporting frame 4 for seat, the adjusting handle 3, the seat base 5, the position-control device 6 and the supporting frame 7 for chassis. The connecting rods 2 are set on the two sides of the chassis pedestal 1 in the way of pivot joining, and the connecting rods are connected with the back. The seat base 5 is axially set on the chassis pedestal 1. One end of the seat base 5 is fixed on the chassis pedestal 1 with the action of the supporting frame 7 for chassis, and the other end is fixed on the seat-supporting locating hole 21. The supporting frame 4 for seat is set on the supporting frame 7 for chassis. Specifically, a setting locating screw 51 for the supporting frame 4 is set on the chassis supporting frame 7, and a sliding-groove 41 for the supporting frame is set on the supporting frame 4 for seat, so that the locating screw 51 for the supporting frame 4 can relatively slide along the sliding-groove 41. The support frame 4 can move forward and backward on the chair chassis. The seat is finally fixed by the seat and the locating holes 42 on the supporting frame 4. The rubberizing shell 8 coordinates with the chassis pedestal 1 to protect the inside mechanical structures of the chassis, or to make it have a better outer frame. The adjusting handle 3 is set on the chassis pedestal 1 with the action of block 39 for the screw-rod sleeve. The position-control device 6 is used to control the locking of unlocking of the forward and backward moving of seat supporting frame 4.

Figure 2:
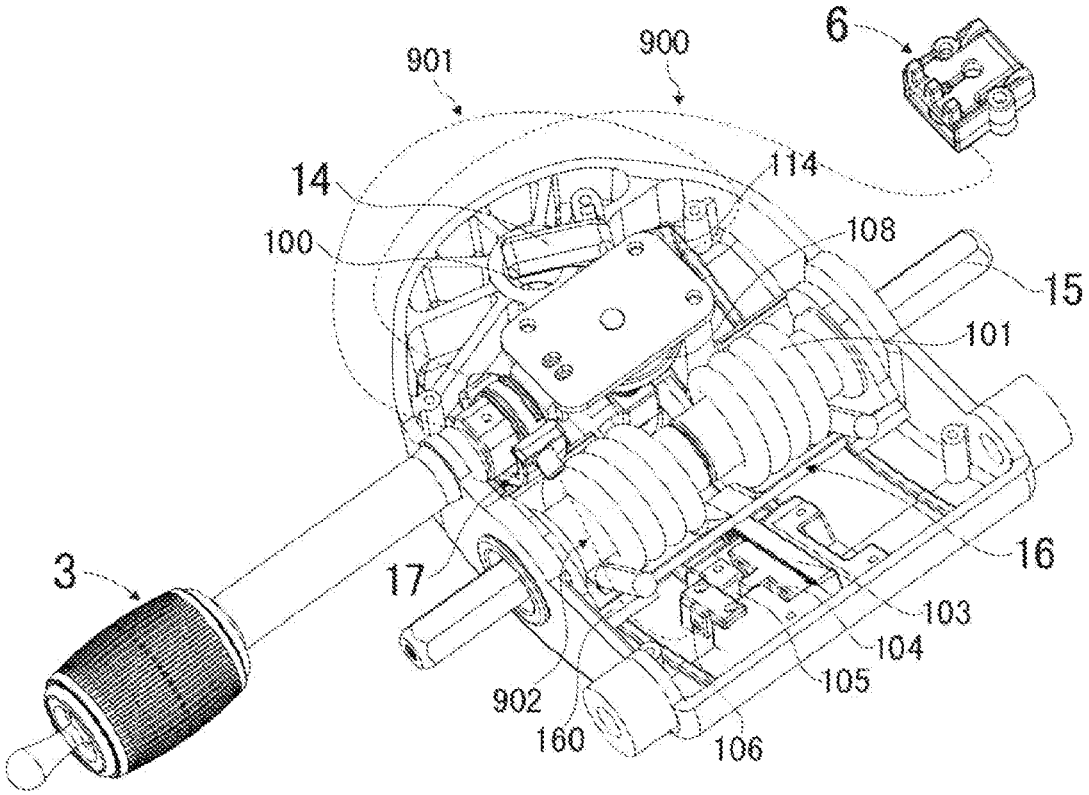
FIG. 2 is a schematic diagram of the FIG. 1 without the part of the rubberizing shell.
Figure 4:
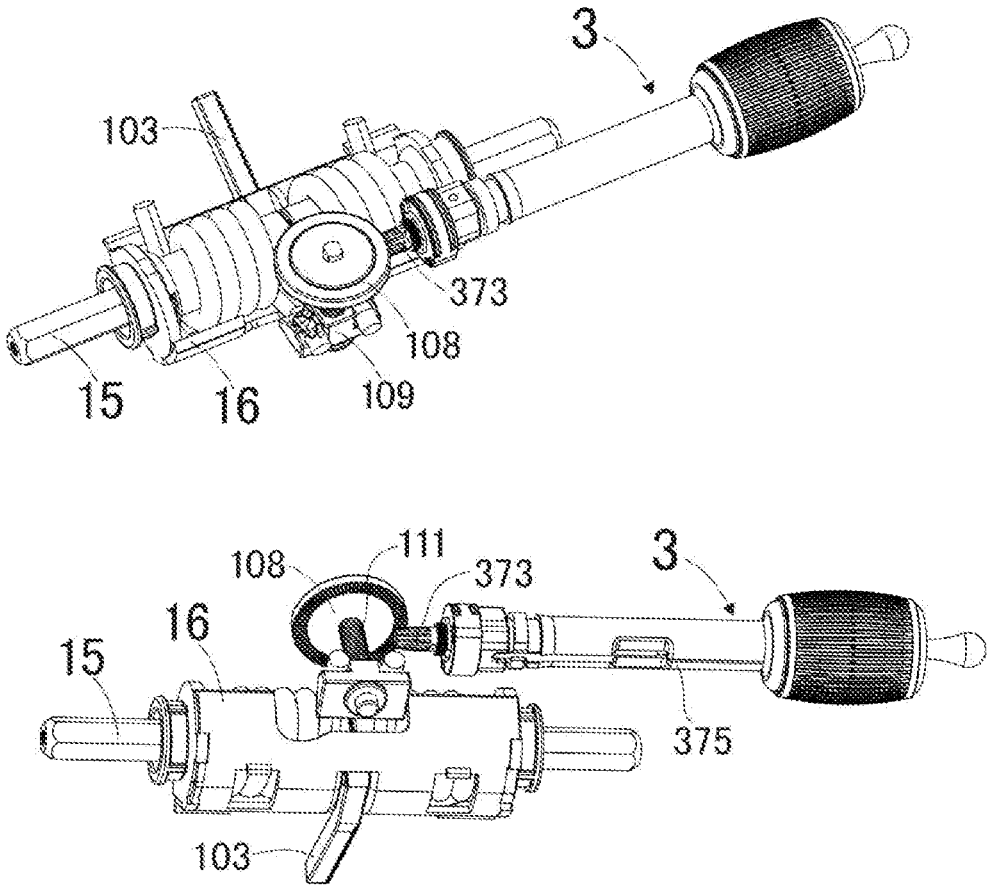
FIG. 4 is a contrast structural diagram of the adjusting of the back's tilting in accordance with the present invention.
Figure 5:
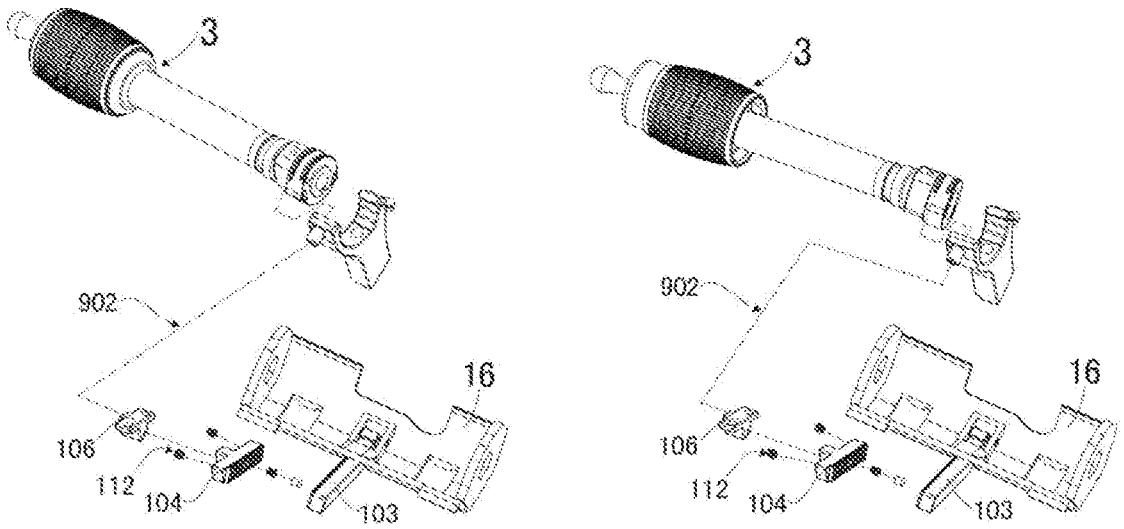
FIG. 5 is a contrast structural diagram of the tilting condition of the back in accordance with the present invention.
Figure 6:
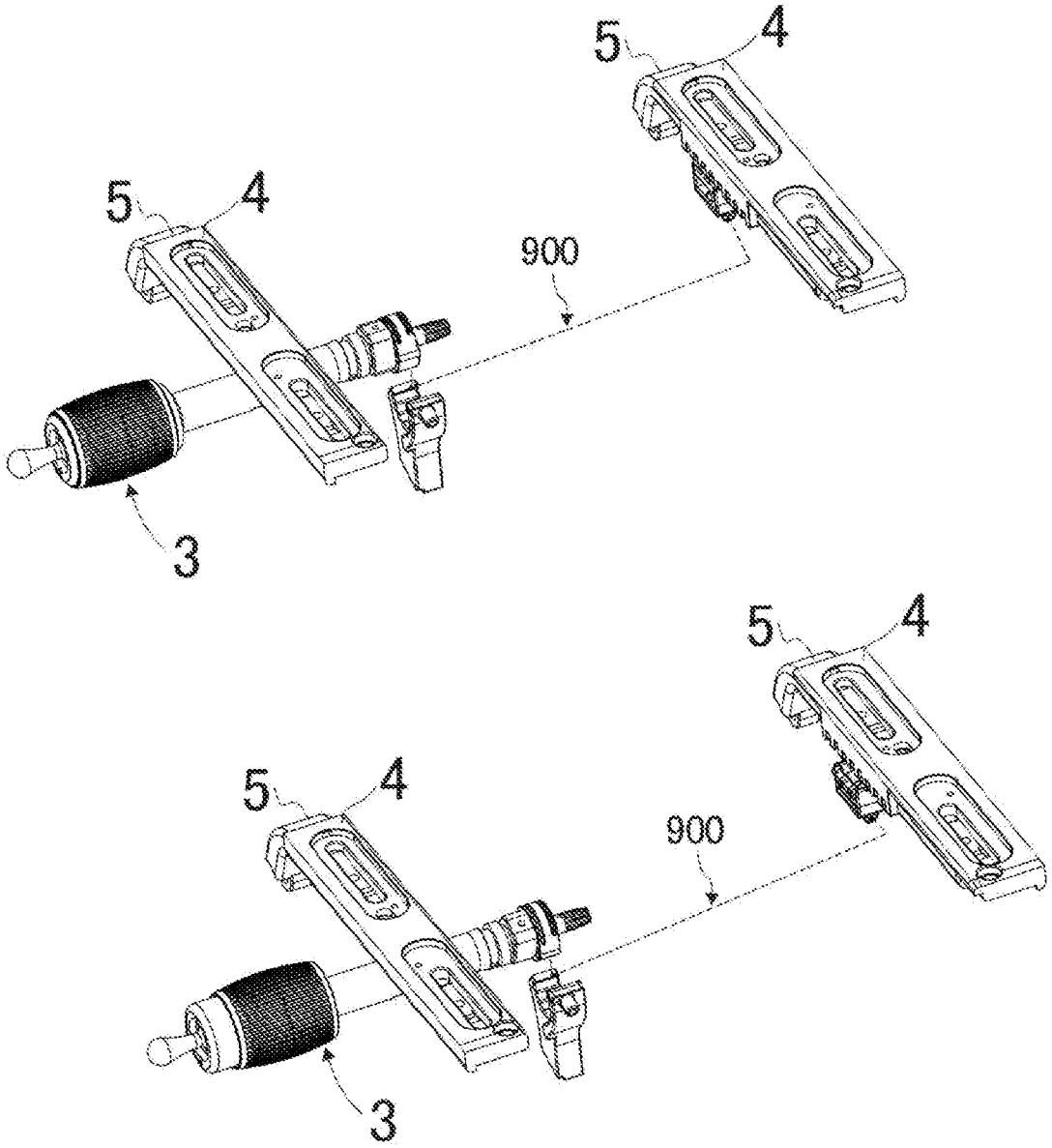
FIG. 6 is a contrast structural diagram of the back and forth moving of the seat in accordance with the present invention.

Referring to FIG. 2, FIG. 4 and FIG. 5, the left and right connecting rod 2 is connected with the chassis pedestal 1 with the action of chassis shaft 15 in the way of pivot joining. The chassis shaft 15 is in a shape of six-angle bar, passing across the chassis pedestal 1. The two ends of the chassis shaft 15 are respectively fixed to the left and right connecting rods 2. In the internal of the chassis pedestal 1 exists a torsion spring 101. The torsion spring 101 is inside of a rotating base 16. The chassis shaft 15 is across the rotating base 16, and the torsion spring 101 is fixed on the rotating base 16. Two sides of the rotating base 16 exist six-angle holes. The chassis shaft 15 passes through the six-angle holes of the rotating base 16 and is fixed with it. Between the chassis shaft 15 and the torsion spring 101 exists a plastic sleeve with the shape of six-angle bar, which is used to prevent the torsion spring 101 from slipping. The rotating base 16 can rotate together with the chassis shaft 15.

There are two torsion springs 101 that are both inside of the rotating base 16. The symmetric ring-sleeve is on the chassis shaft 15. Both of the one end of the two torsion springs 101 are respectively on the two ends of the cavity wall 160 of the rotating base 16. Both of the other end of the torsion springs 101 are on the sliding block 109 that is fixed at the bottom of the elasticity-adjusting screw rod 111. The center of the sliding block 109 is connected with the elasticity-adjusting screw rod 111 in the way of threaded connection, and on the two sides of the sliding block 109 exist positioning stairs. The ends of the two torsion springs 101 are just on the positioning stairs. On the top of the elasticity-adjusting screw rod 111 exists a turntable 108. When it turns around, the sliding block 109 can go up and down. Both of the other end of the two torsion springs 101 are respectively on the two ends of the cavity wall 160 of the rotating base 16. The torsion springs 101 are compressed or loosed. The forces are different according to the elasticity of the torsion springs 101. When the torsion springs 101 are loosed, the rotating base 16 can easily rotate and the connecting rods 2 can also be easily tilted; and when the torsion springs 101 is compressed, the circumstance is absolutely contrary. It can temporarily lock the tilting angle of the connecting rods 2, in order to lock the meshing of the first gear rack 103 and the second gear rack 104.

Figure 9:
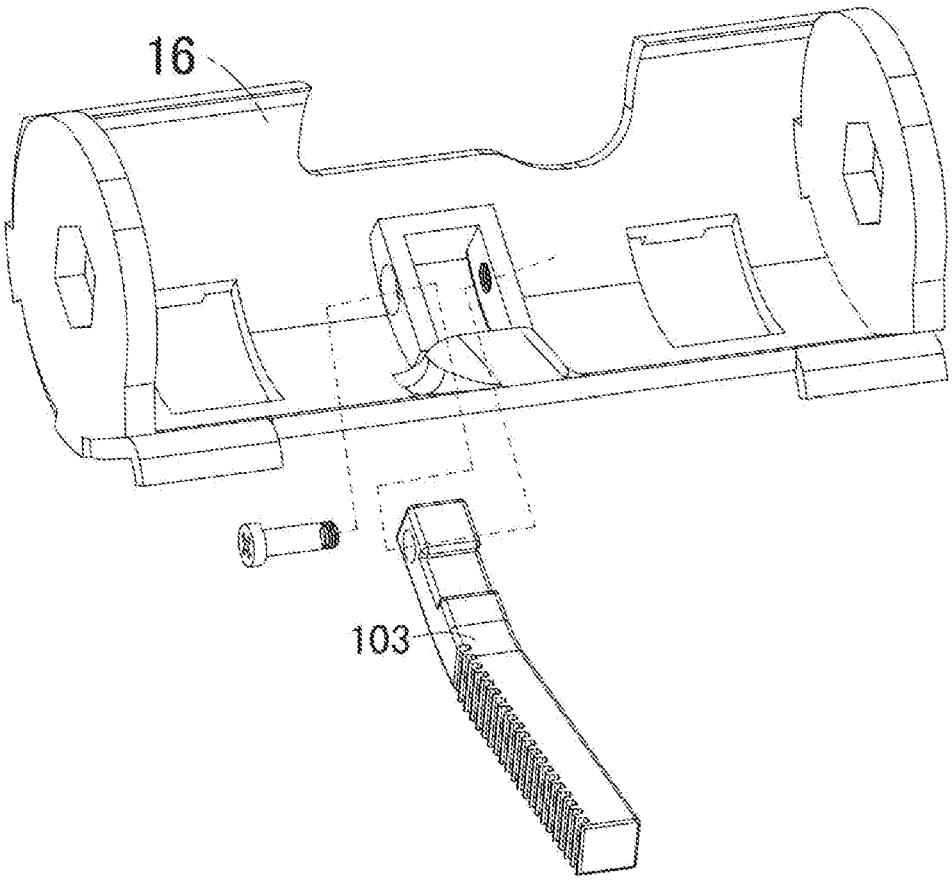
FIG. 9 is a structural diagram of the connecting of the rotating base for torsion spring of FIG. 5 in accordance with the present invention.

In the internal of the chassis pedestal 1 exists the first gear rack 103 and second gear rack 104, which can mesh with each other. At the bottom of the rotating base 16 for torsion spring exists a sliding-groove. One end of the first gear rack 103 is just fixed in the sliding-groove with a long-legged screw or a pin, as shown in FIG. 9. The other end is inside of the chassis pedestal 1 and is movable. The second gear rack 104 is meshed with the first gear rack 103 in the axial direction. In the internal of the chassis pedestal 1 exists a sliding-groove 105 that is perpendicular to the first gear rack 103. The second gear rack 104 is inside of the sliding-groove 105 and it can slide in the sliding-groove 105, in order to mesh or separate with the first gear rack 103. In the back of the second gear rack 104 exists a strengthen spring 112 that is used to strengthen the meshing of the first gear rack 103 and the second gear rack 104. When the second gear rack 104 is meshed with the first gear rack 103, the limitation function of the second gear rack 104 can make the first gear rack 103 be located, so that the rotating base 16 for torsion spring is fixed and the chassis shaft 15 is also fixed. Finally, the left and right connecting rods 2 are also fixed and the tilting position of the back is fixed. When the tilting position of the back needs to be unlocked, we only need to loose the first gear rack 103 and the second gear rack 104.

Figure 7:
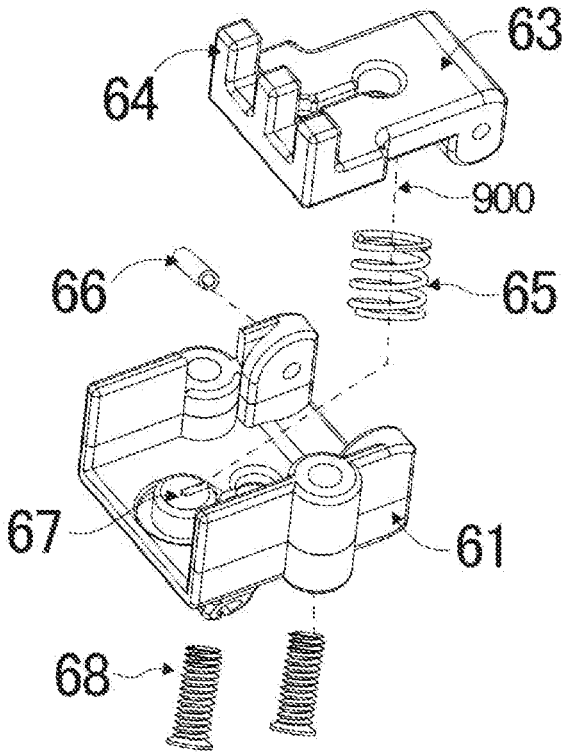
FIG. 7 is a structural diagram of the locking device of the back and forth moving of FIG. 6 in accordance with the present invention.

Referring to FIG. 7, the position-control device 6 that is at the bottom or on the side surface of the base 5 can be used to control the locating of the forward and backward moving of the seat supporting frame 4. The position-control device 6 comprises a pedestal 61, a controlling block 63 for the pedestal. The controlling block 63 is set inside of the pedestal 61 with the pedestal shall 66 in the way of pivot joining. The pedestal 61 is fixed by two screws 68 for the pedestal on the seat base 5. The supporting frame 4 has tooth profiles, and on the controlling block 63 for the pedestal also have controlling teeth 64. The controlling teeth 64 can be meshed with the tooth profiles of the supporting frame 4. Between the controlling block 63 and the pedestal 61 exists a spring 65 for the supporting frame, which is used to strengthen the mesh of the controlling teeth 64 and the supporting frame 4. When the controlling teeth 64 is meshed with the supporting frame 4, the seat supporting frame 4 is located on the seat base 5, the seat is located on chair chassis. When the seat needs to be moved forward and backward, we just need separate the controlling teeth 64 from the tooth profiles of the supporting frame 4, and then the supporting frame 4 can move forward and backward on the seat base 5.

Referring to FIG. 2, on the chassis pedestal 1 exists a mounting hole 100 for pneumatic rod that is connected with the pneumatic rod, which is used in the process of the whole chair's lifting. The lever 14 for pneumatic rod is used to adjust the lifting of the pneumatic rod. The lever 14 for the pneumatic rod is connected with the chassis pedestal in the way of pivot joining. When the lever 14 for the pneumatic rod is pulled, it can control the lifting of the pneumatic rod, which is also the lifting of the chair chassis. When the lever 14 for pneumatic rod is loosed, the chair chassis is stopped from lifting.

Figure 3:
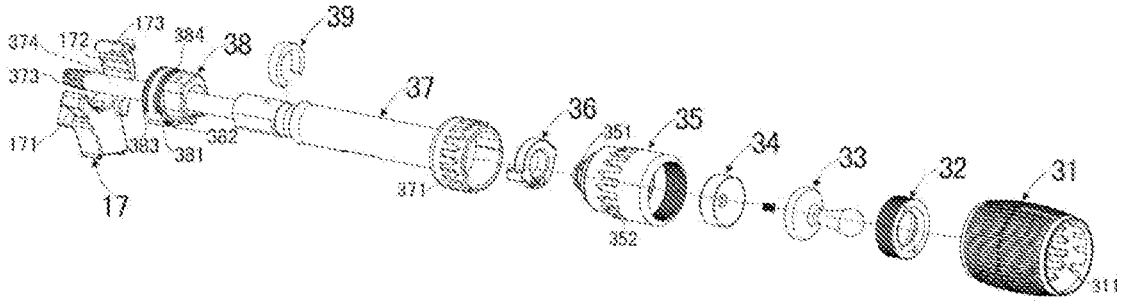
FIG. 3 is a structural diagram of the handle of FIG. 1 in accordance with the present invention.

The main protection parts of the invention are shown in FIG. 3. An adjusting handle 3 comprises an adjusting screw rod 374, a locating block 38 of the handle, a screw rod sleeve 37, a block 36 of the pulling line, an adjusting arm 35 and a knob 31. One end of the screw rod 374 exists the screw teeth 373, and the screw teeth 373 are meshed with the turntable 108 to adjust the tilting angle of the connecting rods 2. The adjusting screw rod 374 is inside of the screw rod 37, and the locating-block 38 for handle is set on the screw rod sleeve 37 and is fixed by a locating pin. The locating block 38 is wrapped with the first pulling line 902 and the second pulling line 900. On the locating block 38 for handle exists two wire-grooves 384 and 383, on which are respectively wrapped with the first pulling line 902 and the second pulling line 900. The wrapping directions of the first pulling line 902 and the second pulling line 900 are contrary. The first pulling line 902 is connected with the second gear rack 104 and used to adjust the locking and unlocking of the tilting position of the back. While the second pulling line 900 is connected with the controlling block 63 for the pedestal on the position-control device 6, and used to adjust the meshing and separating of the controlling teeth 64 on the controlling block 63 for the pedestal and the tooth profiles of the supporting frame 4. The locking or unlocking of the seat's forward and backward moving is controlled.

The end surface of the non-spiral teeth 373 of the adjusting screw rod 374 is connected with the controlling block base 34, and the screw rod sleeve 374 is connected with the adjusting handle 35, which can move axially along the sleeve. The adjusting handle 35 can move axially on the adjusting screw rod 374, but can't rotate. A platform on the adjusting screw rod 374 is matched with the adjusting handle 35 and the holes on the adjusting handle 35 are matched with the platform. We can make the shape of the end surface between the adjusting handle 35 and the adjusting screw rod 374 be around, so that when we rotate the adjusting handle 35, the adjusting screw rod 374 will rotates together with it.

The block 36 for pulling line is set on the adjusting handle 35 and can relatively rotate. The block 36 for pulling line is mounted on the adjusting handle 35 and can slide on it. On the end surface of the adjusting handle 35 exists a blocking sheet 351 that can limit the axially moving of the block 36 for pulling line. The block 36 is fixed with the third pulling line 901. The third pulling line 901 is connected with the lever 14 for pneumatic rod, which is used to control the lifting of the whole chassis. In the rotation process of the adjusting handle 35, the adjusting screw rod 374 will rotate. In order to prevent the third pulling line 901 from being winded on the adjusting screw rod 374, caused by the friction rotation between the block 36 and the adjusting handle 35, it is necessary to limit the rotation of the block 36. We can set the block 36 of the adjusting handle 35 inside of the screw rod sleeve 37 and make the block 36 be movable. Namely, we can set two grooves in the screw rod sleeve 37 along the axial direction and set two groove-blocks on the block 36, which are matched with the grooves, so the groove-blocks can coordinate with the grooves. A groove 375 can be set for the pulling line on the screw rod sleeve 37, which is used to let the third pulling line 901 pass through, so the third pulling line 901 passed through the groove 375 with the action of the block 36. The third pulling line 901 is connected with the lever 14 for pneumatic rod. When the adjusting handle 35 is pulled, as the limitation of groove-block on the block 36, the block 36 is static, while the inside adjusting screw rod 374 will rotate. When the screw rod sleeve 37 rotates alone, the adjusting screw rod 374 is static, and the block 36 for the pulling line and the screw rod sleeve 37 rotate together. Thus, the third pulling line 901 in the groove 375 will not be wrapped on the adjusting screw rod 374.

The controlling-block base 34 is inside of the adjusting handle 35, and the adjusting handle 35 is fixed on the fixed block 32 that is opposite to the controlling block base 34. The fixed block 32 is connected with the internal thread of the adjusting handle 35. Between the controlling block base 34 and the fixed block 32 exists a controlling block 33. The controlling block 33 has a handle. The handle is extended to the outside of the hole of the fixed block 32 and it can swing in the hole of the fixed block 32 in any direction. When the handle-swings, the controlling block 33 is set between the controlling block 34 and the fixed block 32. If the controlling block 33 is pulled, one end of it will be located on the controlling block 34, the other end of it will be tilted because of the lever principle and be fixed on the fixed block 32. The controlling block base 34 and the adjusting screw rod 374 are axially located on the chassis pedestal 1. The controlling block base 34 is static and the controlling block 33 will pry the fixed block 32 and the adjusting handle 35 in the direction that is far away from the chassis pedestal 1. The block 36 for pulling line on the adjusting handle 35 will move along the groove in the screw rod sleeve 37 in the direction that is far away from the chassis pedestal 1. Thus, the pulling line 901 will pull the lever 14, fixed with the end of the pulling line 901 and achieve the goal that the whole chassis can be up and down.

Figure 8:
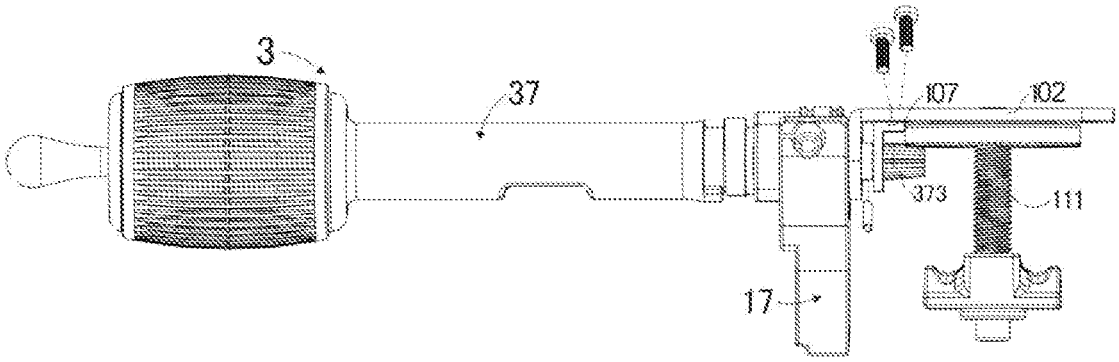
FIG. 8 is a schematic diagram of the locating and connecting of the adjusting handle and the elasticity-adjusting screw rod in accordance with the present invention.

The adjusting screw rod 374 is axially fixed on the chassis pedestal 1. As shown in FIG. 8, the screw rod sleeve 37 is set on the chassis pedestal 1 with the action of the block 39 for screw rod sleeve. On one end of the elasticity-adjusting screw rod 111 exists a fixed iron-sheet 102 and the iron-sheet 102 is above the turntable 108. We can make the top of the elasticity-adjusting screw rod 111 be prism-shaped and set diamond-shaped holes that can be coordinated with it, so that we can achieve the goal of fixing by making the diamond-shaped holes on the iron-sheet 102 be matched with the prism-shaped rod of the elasticity-adjusting screw rod 111. We can also achieve the goal of fixing by the above way, which makes the non-circular shaft and the non-circular holes coordinate with the other. On one end of the iron-sheet 102 exists a vertical-plate and on the vertical-plate exists a hole. The dimension of the hole is matched with the dimension of the adjusting screw rod 374. The adjusting screw rod 374 passes through the hole, and the hole will not restrict the rotation of the adjusting screw rod 374. The limiting sheet 107 is set on the iron-sheet 102. It is bent and is with the "7" shape. One side of the limiting sheet 107 is fixed on the iron-sheet 102 by screws, and the other side is parallel to the vertical-plate. On the vertical edge of the limiting sheet 107 exists a hole. The dimension of which is matched with the dimension of the adjusting screw rod 374. The adjusting screw rod 374 passes through the hole, but the hole will not restrict the rotation of the adjusting screw rod 37. A limiting pin is set between the vertical-plate and the vertical edge of the limiting sheet 107. The limiting pin can't pass through the vertical-plate and the hole on the vertical edge of the limiting sheet 107. The iron-sheet 102, the vertical-plate, the limiting pin and the limiting sheet 107 also have the function of the locating of the elasticity-adjusting screw rod 111.

The screw rod sleeve 37 is connected with the adjusting handle 35 with the action of the knob 31. On the outer surfaces of the screw rod sleeve 37 and the adjusting handle 35 exist concave teeth 371 and 352, which are set face-to-face and can coordinate respectively with the convex teeth 311 on the inner surface of the knob 31. The handle of the controlling block 33 is extended to the outside of the knob 31. Thus, when the knob 31 coordinates with the concave teeth 371 of the screw rod sleeve 37, if the knob 31 is pulled, the screw rod sleeve 37 will also rotate. The locating block 38 of the mounting handle also rotates in different directions, so the one of the first pulling line 902 and the second pulling line 900 of the locating block 38 for handle will act, so the controlling teeth 64 will be meshed with or be separated from the tooth profiles of the first gear rack 103 or the supporting frame 4 to achieve the locking or the unlocking.

On the contrary, when the knob 31 coordinates with the concave teeth 352 of the adjusting handle 35, and if the knob 31 is pulled, the screw rod sleeve 37 is static, while the adjusting screw rod 374 that is connected with the screw rod sleeve 37 will rotate, so that the spiral s teeth 373 are meshed with the turntable 108. The tilting angle of the back is adjusted.

Definitely, when the adjusting back is tilt, the first gear rack 103 of the chassis pedestal 1, and the second gear rack 104 should be firstly separated from the other. Therefore, on the chassis pedestal 1 also exists a locating block 17 for the pulling line, which coordinates with the locating block 38 of the mounting handle. The locating block 17 is fixed by a screw on the chassis pedestal 1. On the locating block 17 for the pulling line exist the locating holes 173 for the first pulling line 902 and the locating hole 171 for the second pulling line 900, which are respectively coordinated with the first pulling line 902 and the second pulling line 900. The gear coordination is achieved by several gear grooves 172 that are set on the locating block 17 for the pulling line, and on the locating block 38 of the mounting handle exist two gear blocks 381 that are matched with the gear groove 172. The gear block 381 is located in the gear groove 172, and the gear block 381 can move back and forth in the gear groove 172 by rotating the locating block 38 for mounting handle. The ends of the first pulling line 902 and the second pulling line 900 are located on the locating hole 382 for pulling line of the gear block 381.

On the first pulling line 902, the second pulling line 900 and the third pulling line 901 respectively exist the locating block 106 for the first pulling line, the locating block 67 for the second pulling line and the locating block 114 for the third pulling line, which are corresponded to the second gear rack 104, the controlling teeth 64 and the terminal of lever 14 for pneumatic rod. In order to prevent the oblique force of the first pulling line 902, the second pulling line 900 and the third pulling line 901, when the second gear rack 104, the controlling teeth 64 and the lever 14 of pneumatic rod are respectively pulled, we should pull the line in the right direction to have the pulling line a longer life and, to pull the line with the least force.

DETAILED OPERATION OF THE INVENTION

1. Make the knob 31 be in coordination with the concave teeth 371 of the screw rod sleeve 37. The knob 31 slide towards the screw rod sleeve 37, and the knob 31 is turned to make the screw rod sleeve 37 rotate, so that the locating block 38 of the mounting handle also rotates with it. The first pulling line 902 separates from the second gear rack 104 and meshes with the first gear rack 103. The gear block 381 on the locating block of the mounting handle 38 is located on the gear groove 172 of the block 17 for the pulling line.

Make the knob 31 be in coordination with the adjusting handle 35, namely, let the knob 31 return back, and turn around the knob 31, to make the adjusting screw rod 374 that is in connection with the adjusting handle 35 rotates, and the spiral teeth 373 of the adjusting screw rod 374 will mesh with the other and rotate together, then the sliding block 109 is lifted and, the elasticity of the torsion spring 101 decreases, at this time, if the user compresses the back, the chassis shaft 15 will be pushed to rotate and, make the rotating base 16 for torsion spring also rotate, then the knob 31 will be turned around in the opposite direction, then the elasticity of the torsion spring 101 increases.

Finally, the knob 31 is coordinated with the concave teeth 371 of the screw rod sleeve 37 and is turned around to make the second gear rack 104 mesh with the first gear rack 103, so that the back is adjusted and locked.

2. Make the knob 31 be in coordination with the concave teeth 371 of the screw rod sleeve 37. The knob 31 slides towards the screw rod sleeve 37 and is turned around to make the screw rod sleeve 37 also rotate, so that the block 38 for mounting handle will rotate with it. The second pulling line 900 makes the controlling teeth 64 separate from the support frame 4, and this adjusts the seat to the appropriate position, then the knob 31 is turned around in the opposite direction to make the controlling teeth 64 return to the original position. Thus, the above operation completes the adjustment of the seat and the locking function.

3. Swing the handle of the controlling block 33 in any direction, to make the fixed block 32 and the adjusting handle 35 be axially located on the chassis pedestal 1 with the action of the adjusting screw rod 374 and the controlling block base 34, so the fixed block 32 and the adjusting handle 35 will be far away from the spiral teeth 373, and then this makes the block 36 pull the third pulling line 901, and finally, the lever 14 for pneumatic rod is pulled to adjust the lift of the whole chair. When the handle of the controlling block 33 returns back, the lever 14 will also return back to stop the lifting.

While, the present invention has been illustrated by the above description of the preferred embodiments and figures thereof, while the preferred embodiments have been described in considerable detail, it is not intended to restrict or in any way limit the scope of the appended claims to such details, other advantages and modification skilled in the art. Therefore, the present invention is not limited to the specific details and the illustrative examples shown and described.

What is claimed is:

1. A chair chassis, comprising a chassis pedestal, on which exist a left and right connecting rod that is tiltable;

a supporting frame that can move forward and backward;

an adjusting handle, which is fixed axially on the chassis pedestal, wherein the adjusting handle comprises an adjusting screw rod, and on one end of the adjusting screw rod exists spiral teeth;

a locating block of a mounting handle is set on the adjusting screw rod, a first pulling line is wrapped around the locating block of the mounting handle, and the first pulling line can lock or unlock the tilting angle of the left and right connecting rod;

wherein a second pulling line is wrapped around the locating block of the mounting handle, which can lock or unlock the position of the supporting frame, a wrapping direction of the second pulling line is opposite to a wrapping direction of the first pulling line; and wherein the adjusting handle comprises a block of pulling line, and the block of pulling line is fixed with a third pulling line, which can control a rising or descending of the chassis, and the block of pulling line can relatively slide along the adjusting screw rod.

2. The chair chassis of claim 1, wherein a screw rod sleeve is connected with the adjusting handle with a knob, which is outside of a sliding sleeve, and the knob coordinates with the screw rod sleeve.

3. The chair chassis of claim 1, wherein the left and right connecting rod is connected with the chassis pedestal by a chassis shaft, in the chassis pedestal exists a torsion spring, a torsion spring rotating base, the torsion spring is inside of the torsion spring rotating base, the chassis shaft passes through the torsion spring rotating base and the torsion spring, and the chassis shaft is fixed on the torsion spring rotating base, two ends of the chassis shaft are respectively connected with the left and right connecting rod;

one end of the torsion spring is on a cavity wall of the rotating base, and another end is on a sliding block that is fixed at a bottom of an elasticity-adjusting screw rod, on the top of the elasticity-adjusting screw rod exists a turntable that is meshed with the spiral teeth;

in the chassis pedestal, there exist a first gear rack and a second gear rack, which can mesh with each other, one end of the first gear rack is fixed in a sliding groove that is on the torsion spring rotating base, the other end is freely set; the second gear rack can slide inside the chassis pedestal, so that it can mesh with or separate from the first gear rack, the second gear rack is connected to the first pulling line.

4. The chair chassis of claim 1, wherein the adjusting handle comprises a screw rod sleeve, and the adjusting screw rod is inside of the screw rod sleeve, the locating block of the mounting handle is fixed on the screw rod sleeve;

on the chassis pedestal also exists a locating block of pulling line that coordinates with the locating block of the mounting handle, and on the locating block of pulling line exists a locating hole of the first pulling line and a locating hole of the second pulling line.

5. The chair chassis of claim 1, wherein an end surface of the adjusting screw rod which does not have spiral teeth is connected with a controlling block base, and on an adjusting screw rod sleeve exists an adjusting handle that can slide axially along the adjusting screw rod sleeve, the controlling block base is set in the adjusting handle, the block of pulling line is on the adjusting handle and can relatively rotate with the adjusting handle and, inside of the adjusting handle exists a fixed block with holes that are opposite to the controlling block base; between the controlling block base and the fixed block-exists a controlling block, and a handle of the controlling block is extended to outside of holes of the fixed block, the handle of the controlling block can swing freely in any direction in the holes of the fixed block.

6. The chair chassis of claim 1, wherein a supporting frame is set on a seat bracket that is on two sides of the chassis pedestal, and the supporting frame can relatively slide on the seat bracket, at a bottom or side surface of the supporting frame exists a position-control device, the position-control device comprises a base and controlling teeth, which are connected with the base by pivot joining, the controlling teeth are meshed with teeth of the supporting frame, the controlling teeth are connected with the second pulling line.

7. The chair chassis of claim 6, wherein on the chassis pedestal exists a mounting-hole of a pneumatic rod that is connected with the pneumatic rod, a lever of the pneumatic rod is on the mounting-hole of the pneumatic rod and is connected with the chassis pedestal by pivot joining, and the lever of the pneumatic rod is connected with the third pulling line.

8. The chair chassis of claim 7, wherein on the first pulling line, the second pulling line and the third pulling line respectively exist the locating block of the first pulling line, the locating block of the second pulling line and a locating block of the third pulling line, which are corresponded to a second gear rack, the controlling teeth and a terminal of the lever of the pneumatic rod.

* * * * *